United States Patent [19]

Hyland et al.

[11] 4,408,413

[45] Oct. 11, 1983

[54] DYNAMIC TOY APPARATUS

[76] Inventors: Joseph Hyland, 344 E. 63 St., New York, N.Y. 10021; Joseph J. Wetherell, 20 Woodsbridge Rd., Katonah, N.Y. 10536

[21] Appl. No.: 312,738

[22] Filed: Oct. 19, 1981

[51] Int. Cl.[3] ..... A63H 33/26

[52] U.S. Cl. ..... 46/241; 46/1 K

[58] Field of Search ..... 46/241, 236, 1 K, 65, 46/50, 67

[56] References Cited

U.S. PATENT DOCUMENTS

| | | | |
|---|---|---|---|
| 960,715 | 6/1910 | Schneider | 46/241 |
| 1,005,853 | 10/1911 | Lewis | 46/241 |
| 3,466,796 | 9/1969 | Greenblatt | 46/241 |
| 4,031,660 | 6/1977 | Chen | 46/241 |
| 4,146,991 | 4/1979 | Sano | 46/1 K X |
| 4,161,279 | 7/1979 | Halford | 46/1 K X |

FOREIGN PATENT DOCUMENTS

| | | | |
|---|---|---|---|
| 548571 | 1/1923 | France | 46/65 |

*Primary Examiner*—Mickey Yu

*Attorney, Agent, or Firm*—Natter & Natter

[57] ABSTRACT

A track system includes an accelerator track section having a ferrous metal accelerator rod which attracts a magnetized spinning top and imparts a linear acceleration to the top. Additional coaster and turn track sections provide a selected glide path for the freely moving top. Alternate embodiments of the accelerator track sections include the incorporation of a guide channel, a "T" shaped accelerator strip, a planar accelerator strip, and a dual sided accelerator strip.

14 Claims, 9 Drawing Figures

FIG. 6
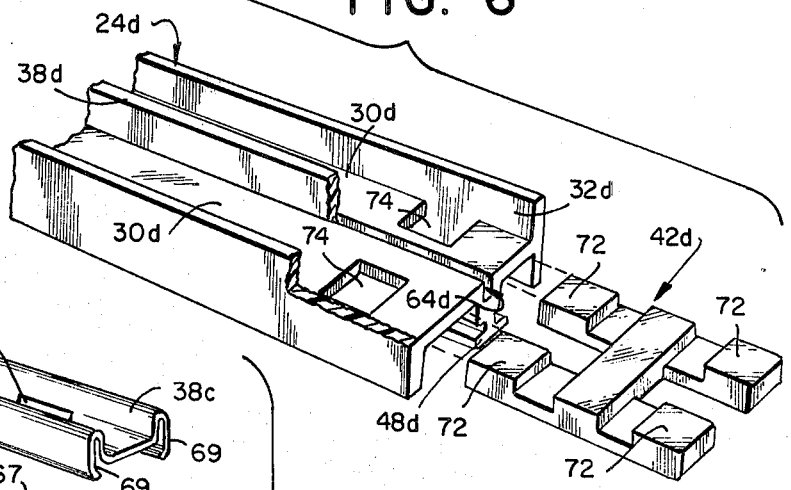
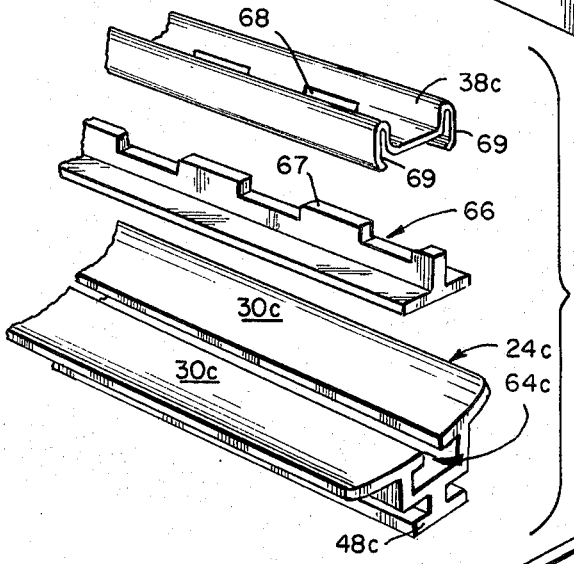
FIG. 5
FIG. 7
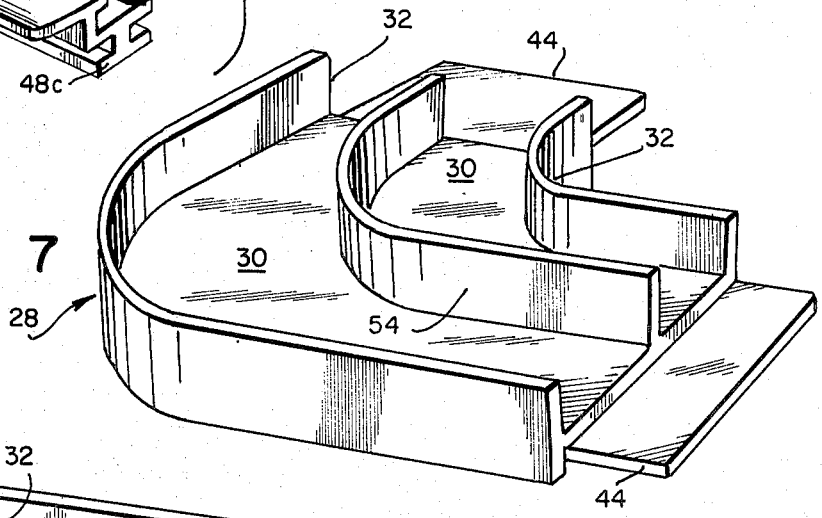
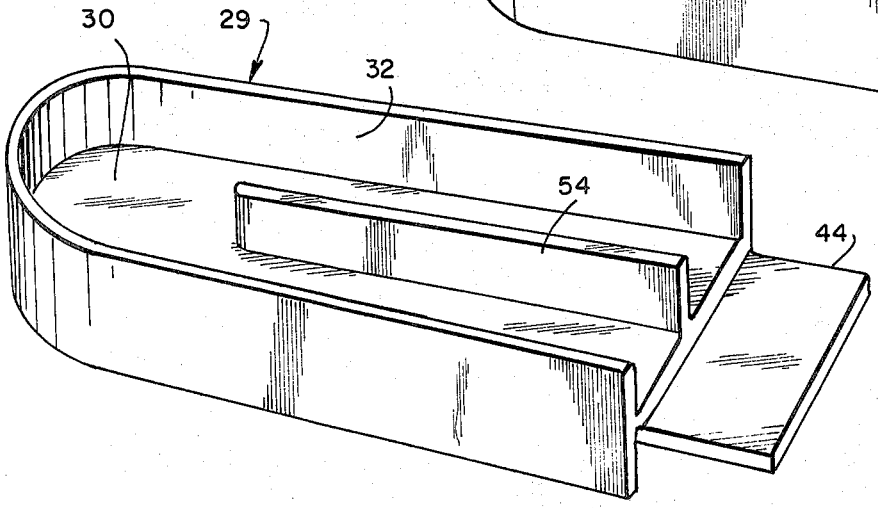
FIG. 8

DYNAMIC TOY APPARATUS

BACKGROUND OF THE INVENTION

1. Field of the Invention

This invention relates to amusement devices and especially to a magnetic spinning device and track system.

In particular, the track system of this device magnetically interacts with the spinning device to impart a forward motion for propelling the device along a selected glide path.

2. Description of the Prior Art

Prior art action toys which had utilized track guidance systems generally included miniature vehicles such as racing cars or trains which traversed a predetermined path of travel. The vehicles were usually provided with a self-contained motor for furnishing the propelling force and frequently were subject to mechanical malfunctioning. Furthermore, those toy apparatus did not rely upon a magnetic field for accelerating the vehicle and influencing the path of travel. A further shortcoming of those prior art toy devices was that the mechanical drive elements increased the cost of manufacture.

The present invention in contrast utilizes the kinetic energy of a spinning top which is transformed to translatory motion. A characteristic of this dynamic toy apparatus is that it utilizes a magnetic field in effecting the energy conversion. It should thus be apparent that undesirable frictional losses in the prior art mechanical drive systems are substantially eliminated in the instant invention.

Although various types of magnetized toy tops were illustrated in U.S. Pat. Nos. 960,715, 1,005,853, 1,198,578, 3,330,067, 3,466,796, and 4,031,660, those devices did not integrate a track accelerator and guidance system for supporting a vertically oriented spinning top along one end of its axle, nor did they provide for "free flight".

Another improvement over those previous top devices concerns the utilization in the present invention of a plurality of track sections in a cooperative manner to linearly accelerate the top for translation along a "free flight" path.

In view of the foregoing, it should be apparent that the present invention overcomes many of the shortcomings of the prior art devices and provides an improved dynamic toy apparatus which eliminates many of the problems in the prior art.

SUMMARY OF THE INVENTION

Briefly, the nature of this invention concerns a dynamic toy apparatus having a magnetized top and a track system.

The top includes a circular fly wheel or disc-like body portion having a magnetized axle extending substantially perpendicularly to the plane of the body portion on either side of the fly wheel. A plurality of track sections are adapted for selective interconnection to form a closed loop or runway for the top. The track system includes several alternate forms of track sections, for example, linear sections, curved sections, and turn sections. In addition, some of the track sections include an accelerator element for coacting with the magnetic axle of the top and for thus imparting a linear velocity to the rotating body. The other track sections provide directional guidance to the freely coasting top.

Alternate forms of construction for the track sections incorporating the accelerator element have further been disclosed herein. In addition, some of the track sections provide a peripheral barrier or side wall for securing the spinning top within the track perimeter.

A feature of this invention includes the introduction of universal coupling members for lockingly interconnecting the track sections. In addition, support pylons are adapted for interfitting connection with the track sections and include variable height adjustment for providing an inclined track or ramp.

Having thus summarized the invention, it will be seen that it is an object thereof to provide a dynamic toy apparatus of the general character described herein which is not subject to the aforementioned disadvantages.

Specifically, it is an object of this invention to provide a dynamic toy apparatus utilizing a magnetic spinning device which travels along a predetermined circuit.

A further object of this invention is to provide a dynamic toy apparatus which utilizes the kinetic rotary energy of a spinning top for conversion to translatory motion.

A still further object of this invention is to provide a dynamic toy apparatus having a plurality of track sections selectively interconnectable for forming an acceleration and guidance system.

An additional object of the present invention is to provide a dynamic toy apparatus wherein the track system includes a track section having a snap-fitting metal rod for attracting and propelling the magnetized spinning top.

Still another object of this invention is to provide a dynamic toy apparatus of the general character described which is simple in construction, low in cost, reliable in use, and well adapted for mass production and fabrication techniques.

Other objects of the invention in part will be apparent and in part will be pointed out hereinafter.

With these ends in view, the invention finds embodiment in certain combinations of elements and arrangements of parts by which the aforementioned objects and certain other objects are hereinafter attained, all as fully described with reference to the accompanying drawings and the scope of which is more particularly pointed out and indicated in the appended claims.

BRIEF DESCRIPTION OF THE DRAWINGS

In the accompanying drawings in which are shown possible exemplary embodiments of the invention.

FIG. 5 is a perspective view showing a portion of another form of an accelerator track in exploded fashion illustrating a dual sided accelerator contact strip for providing greater contact area with the top;

FIG. 6 is a perspective view of a portion of a modified form of an accelerator track and coupling member with a portion of the track section broken away for illustrating a planar accelerator strip and coupling engagement recesses;

FIG. 7 is a perspective view to an enlarged scale showing a 90 degree curve track section including integral coupling tabs; and FIG. 8 is a perspective view to an enlarged scale of a 180 degree turnaround track section and showing a coupling tab.

DESCRIPTION OF THE PREFERRED EMBODIMENTS

Figures 1, 2A:
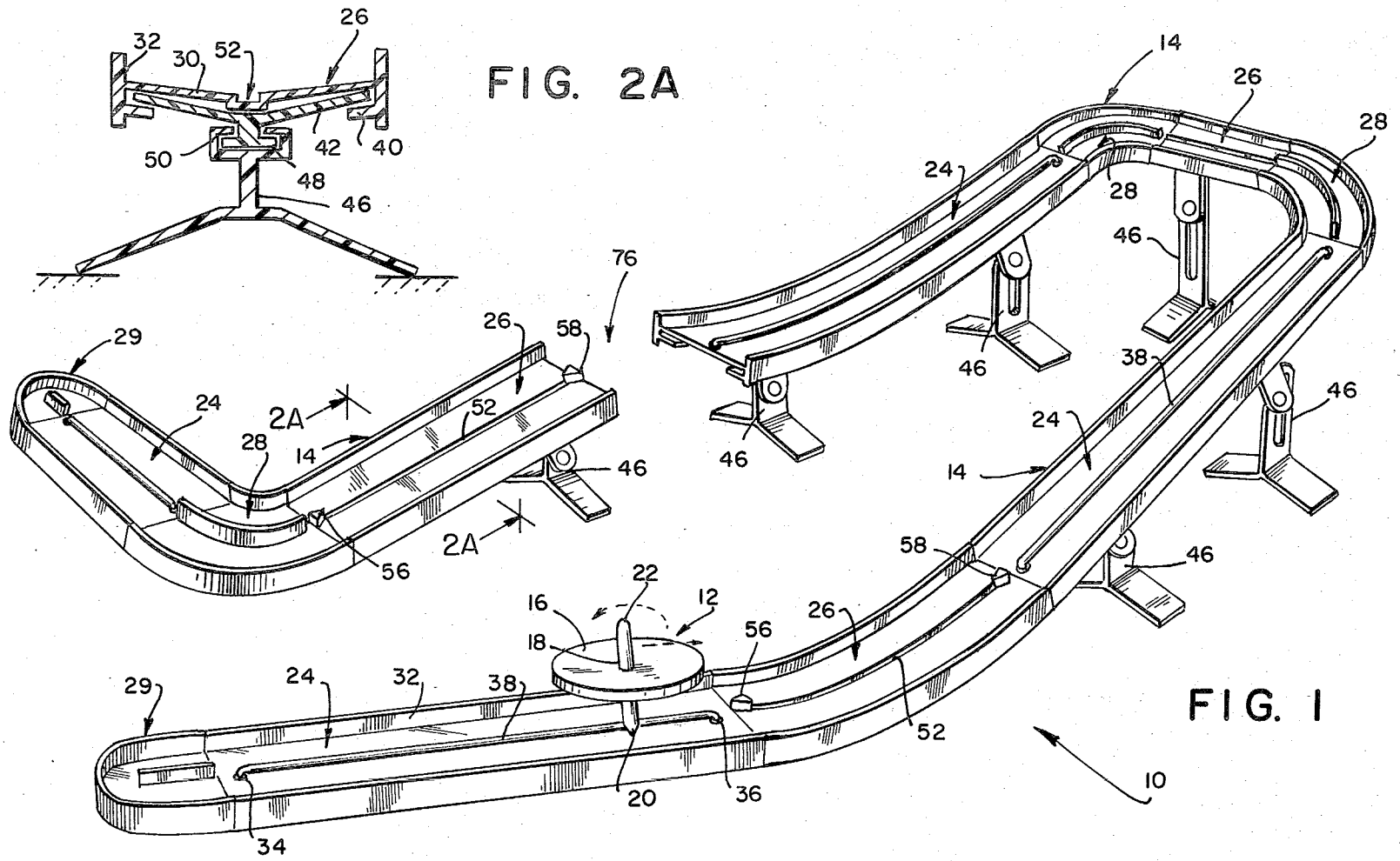
FIG. 1 is a perspective view of a dynamic toy apparatus of this invention showing a typical track layout with a magnetic spinning top thereon.
FIG. 2A is a sectional view to a slightly enlarged scale taken substantially along line 2A—2A of FIG. 1 and showing a coaster track having a sloped runway and longitudinal groove.

Referring now in detail to the drawings, the reference numeral 10 denotes generally a dynamic toy apparatus of this invention. The toy apparatus 10 is illustrated in a typical embodiment shown in FIG. 1 and includes a top 12 and a track guidance system 14. The top 12 includes a disclike body portion 16 and an axle or stem 18, one end of which is pointed as at 20 with the distal end 22 providing a shaft for imparting a rotary spinning motion to the body 16. This may be accomplished by hand through the use of a cord, a launching mechanism or through other conventionally used devices. The stem 18 of the present invention, including the pointed tip 20 is magnetized to form a permanent magnet. It should also be understood that the stem 18 can also be magnetized at both of its ends.

The track guidance system 14 provides a runway for the top 12, as will be further described hereinafter, and includes a plurality of track sections which can be selectively assembled to provide a continuous loop or other selected paths of travel.

Figure 2:
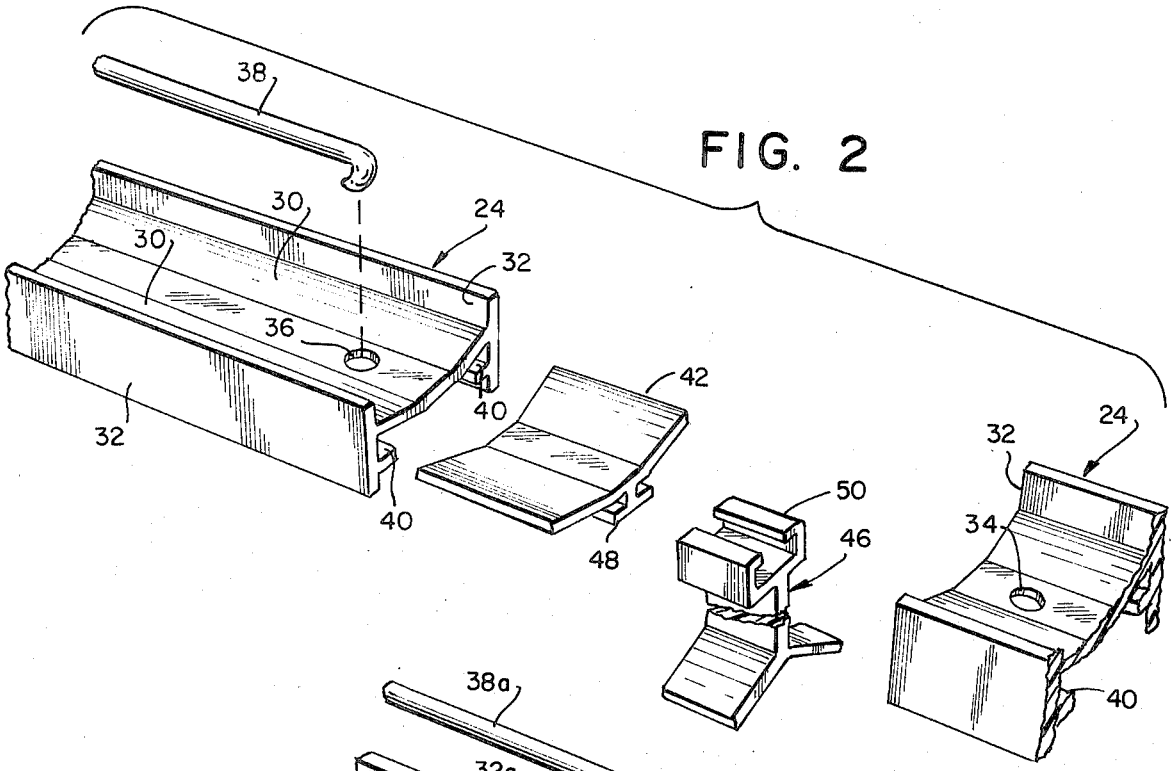
FIG. 2 is an enlarged perspective view shown in exploded fashion for clarity illustrating a portion of an accelerator track with an accelerator rod, a coupler device for joining an adjacent track section and a support pylon.

For this purpose, the track system 14 includes a launching or accelerator track 24, a coaster track section 26, a 90 degree curved track section 28 and a 180 degree turnaround track section 29. The track sections are preferably injection molded from a plastic material such as polyethylene and include a runway 30 and a continuous side barrier 32. The runway 30 is preferably angled from each of the side barriers 32 as shown on the track 24 toward a central longitudinal area (see FIG. 2). Furthermore, the central area is provided with two apertures 34, 36 which can be die-punched. A ferrous metal accelerator rod 38 is provided with bent or inturned opposite ends adapted to snap fit into the respective apertures 34, 36. The rod 38 can be factory preassembled, or alternatively this assembly can be completed by the consumer. The sloped runway 30 urges the spinning toy 12 into continuous contact with the rod 38.

As previously mentioned, the track sections 24, 26 are adapted for selective interconnection, and for that purpose the undercarriages of these tracks include a pair of continuous flanges 40 for snugly gripping a dual winged track connector 42. In this manner two contiguous track sections 24, as in FIG. 2, can be locked together. With regard to the curved and turn-around sections 28, 29, a projecting tab 44 locks into the flanges 40 in a similar fashion.

Track sections 24, 26 are supported by an adjustable pylon 46. The pylon 46 has a coupling head 50 which slides over a companion plug member 48 depending from the connector 42. It should be noted that the connector 42, for this purpose, can be slidably positioned at a desired location along the undercarriage of the track.

The coaster track section 26 is substantially identical to the accelerator track 24 in all respects, except that it is not provided with the apertures for receiving an accelerator rod and in place thereof includes a longitudinal guidance groove 52. The groove 52 stabilizes the top 12 as it traverses the track during "free flight".

The track sections 28, 29 shown in FIGS. 7 and 8 include a longitudinal median barrier 54 for steering the top 12 in this "free flight" mode. It should also be noted that the coaster track 26 is provided with deflector members 56, 58 for directional control. The deflectors 56, 58 insure that, as the top 12 leaves the coaster track, it will be positioned along one side or the other of the accelerator rod 38.

Figure 3:
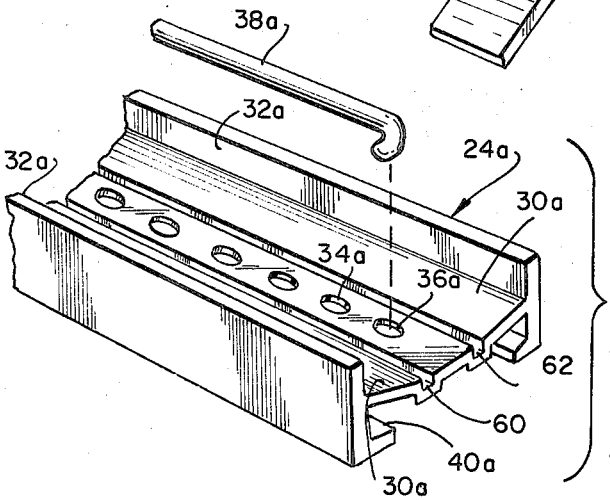
FIG. 3 is a partial perspective view to an enlarged scale of an alternate form of an accelerator track section including a pair of guide channels and a series of apertures for allowing insertion of an accelerator rod at any desired location.

In a modified embodiment shown in FIG. 3 wherein like numerals of the previous embodiment have been utilized for representing corresponding parts with the suffix "a", an accelerator track **24*a* includes a runway section 30*a*, a side barrier 32*a* and a pair of flanges 40*a* for receiving a track connector (not shown). In addition, a plurality of spaced apertures 34*a*, 36*a* etc. are adapted for receiving an accelerator rod 38*a* as discussed in connection with the previous embodiment. The runway 30*a* is provided with two longitudinal grooves 60, 62 for guiding the top into continuous contact with the rod 38*a* as it travels on either side thereof. In addition, the flexible accelerator track section 24*a* can be bent, curved or otherwise flexed and held in that position by the accelerator rod 38*a* which, for this purpose, can be inserted into any of the plurality of apertures 34*a*, 36*a* etc. This arrangement provides for firm securement of the rod 38*a* which is held in place by the resilient spring action of the track section. In all other respects track 24*a* is identical to track 24**.

Figure 4:
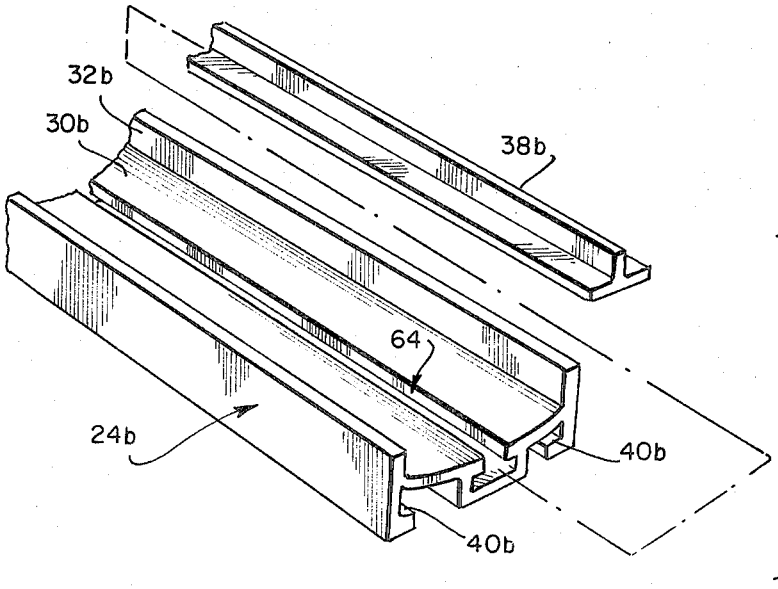
FIG. 4 is a perspective view of a portion of a variant accelerator track illustrating a "T" shaped accelerator strip.

Another variant form is shown in FIG. 4 wherein like numerals have been used to represent similar elements of the previous embodiment with the addition of the suffix "b". An accelerator track **24*b* includes a runway section 30*b*, a side barrier 32*b*, and a pair of flanges 40*b*. An extruded metal rail 38*b* is adapted to be slidably received for assembly within a companion groove 64. In all other respects, the accelerator track 24*b*** is similar to the first preferred embodiment described herein.

A still further variation of the accelerator track is noted in FIG. 5 wherein like numerals have been used to represent corresponding elements with the suffix "c". An accelerator track section **24*c* includes a runway 30*c*, a plug 48*c* and a companion groove 64*c* for receiving an injection molded notched rail 66. A stamped metal accelerator strip 38*c* is provided with slotted openings 68 which register with the notched portions 67 of rail 66 for snap fit interconnection. The accelerator strip 38*c* includes two longitudinal rib sections 69 for providing greater contact area with the top. This modification does not employ side barriers and has a curved runway 30*c***.

FIG. 6 illustrates another version of the accelerator track and track connector. In this embodiment like reference numerals have similarly been used to represent corresponding parts as in the previously described embodiments with the suffix "d" being used herein.

An accelerator track 24*d* is provided with a runway 30*d* and side barriers 32*d*. A longitudinal groove 64*d* is adapted for receiving a planar accelerator strip 38*d*. In addition, a track connector 42*d* includes projecting lugs 72. The runway 30*d* is furnished with companion recesses 74 for achieving an interlocking connection with the projecting lugs 72 of the track connector 42*d*. In addition, a depending plug 48*d* is included for a supporting pylon (not shown).

The dynamic toy apparatus 10 can be used in the following manner, however other applications should be apparent and are within the purview of this invention. Initially, the track sections 24, 26, 28, 29 are assembled to form a continuous loop or other circuit. In the exemplary embodiment of FIG. 1, a closed circuit is presented except for a gap 76 providing an area for a space jump by the top 12. It should also be noted that the height adjustment, placement and number of accelerator track sections 24 will become apparent, however it may require alternate assemblies to arrive at the most advantageous arrangement. After the track system has been set up, a rotary motion is imparted to the top 12 as illustrated by the arrows in FIG. 1, and then it is placed on an accelerator track 24 in contact with the accelerator rod 38. The stem 18 of the energized top 12 will be attracted to the accelerator rod 38 and the spinning motion will be converted to forward motion (in direction of broken line arrow) causing the top 12 to traverse along the several track sections. The forward motion thus imparted to the top 12 should be sufficient for launching the top 12 over the coaster track section 26 and turn sections 28, 29. The intermediate placement of additional accelerator sections 24 will help to boost the velocity of the top 12. In addition, the height orientation of the inclined track will provide additional forward momentum on the downslope and will permit the top 12 to "jump" the gap 76.

Referring now to the coaster track section 26, the typical section is provided with a groove for guiding the pointed tip 20. Furthermore, the deflectors 56, 58 provide directional assistance to the top. It should be noted that the top 12 will travel equally well on either side of the accelerator rod 38 and therefore can travel in both directions on the same section of track. It should thus be observed that the track sections do not have to be assembled in a continuous loop. In order to facilitate the turning and reversal of the direction of travel, the 90 degree turn section 28 and the 180 degree turnaround section 29 have been provided. Also several tops can be used simultaneously with the track system.

Thus, it will be seen that there is provided a dynamic toy apparatus which achieves the various objects of the invention and which is well adapted to meet conditions of practical use.

Since various possible embodiments might be made of the present invention and various changes might be made in the exemplary embodiments set forth, it is to be understood that all material set forth or shown and described in the accompanying drawings is to be interpreted as illustrative and not in a limiting sense.

Having thus described the invention, there is claimed as new and desired to be secured by Letters Patent:

1. A dynamic toy apparatus utilizing kinetic rotary energy of a spinning top for conversion to translatory motion comprising a top having a stem and a body portion, stationary guidance means having a runway for supporting the spinning top on one end of the stem in a substantially vertical orientation, the guidance means further having acceleration means including an elongated member mounted within said runway, said member being adapted for providing a contact surface for said end of the stem and for magnetically interacting therewith to impart a linear velocity to the top.

2. A dynamic toy apparatus as claimed in claim 1 wherein the acceleration means includes an accelerator track, said track being provided with an elongated ferrous member.

3. A dynamic toy apparatus as claimed in claim 2 wherein the accelerator track is provided with side barriers along the margin of said runway for confining said spinning top within the runway.

4. A dynamic toy apparatus as claimed in claim 3 wherein the runway defines a sloped surface from each of the side barriers toward a longitudinal axis of the track member for urging the spinning top into contact with the acceleration means.

5. A dynamic toy apparatus as claimed in claim 2 wherein the runway includes a plurality of apertures and the elongated member defines a rod, said rod being mounted to said runway by engagement with respective apertures.

6. A dynamic toy apparatus as claimed in claim 5 wherein a plurality of apertures are provided along the runway, said accelerator track further being flexibly deformable for registering selected apertures for engagement with said rod, said rod being fixedly held in position by the flexible action of the accelerator track.

7. A dynamic toy apparatus as claimed in claim 1 wherein the acceleration means includes an accelerator track, said track being provided with an elongated T-shaped member, said accelerator track further including a recess for accommodating said T-shaped member.

8. A dynamic toy apparatus as claimed in claim 1 wherein the acceleration means includes an accelerator track, said track including a vertically oriented planar member, said accelerator track further including a longitudinal groove for accepting said planar member.

9. A dynamic toy apparatus as claimed in claim 1 wherein said acceleration means includes an accelerator track, said track including a dual sided strip, said strip being engageable over a complementary notched rail, said rail being accommodatable within a recess formed in said accelerator track.

10. A dynamic toy apparatus as claimed in claim 1 wherein the guidance means further includes a coaster track, said coaster track having a runway defining longitudinal groove means for accommodating said end of the stem portion of the spinning top when traversing said coaster track.

11. a dynamic toy apparatus as claimed in claim 10 wherein the guidance means further includes a curved track, said curved track having a runway defining a median barrier for altering the path of travel of the spinning top.

12. A dynamic toy apparatus as claimed in claim 11 wherein the track is provided with flange means below said runway, a track connector, said flange means being adapted for slidably receiving the track connector whereby contiguous tracks are interconnected.

13. A dynamic toy apparatus as claimed in claim 12 further including pylon means for supporting the track members at selected elevations, said pylon means having coupling means for engaging said track connector.

14. A dynamic toy apparatus as claimed in claim 11 including a track connector having projecting lugs, said tracks being provided with companion recesses for receiving mating lugs to interlock contiguous tracks.

* * * * *